US012551943B2

(12) United States Patent
Grosseiber et al.

(10) Patent No.: US 12,551,943 B2
(45) Date of Patent: Feb. 17, 2026

(54) CASTING-ROLLING INTEGRATED PLANT FOR PRODUCING A HOT-ROLLED FINISHED STRIP FROM A STEEL MELT

(71) Applicant: Primetals Technologies Austria GmbH, Linz (AT)

(72) Inventors: Simon Grosseiber, Leonding (AT); Thomas Lengauer, Weißkirchen a.d. Traun (AT); Bernd Linzer, Leombach (AT); Gero Schwarz, Attnang (AT); Roman Winkler, Altenberg (AT); Michael Zahedi, St. Marien (AT)

(73) Assignee: Primetals Technologies Austria GmbH (AT)

( * ) Notice: Subject to any disclaimer, the term of this patent is extended or adjusted under 35 U.S.C. 154(b) by 0 days.

(21) Appl. No.: 18/005,521

(22) PCT Filed: Jun. 16, 2021

(86) PCT No.: PCT/EP2021/066278
§ 371 (c)(1),
(2) Date: Jan. 13, 2023

(87) PCT Pub. No.: WO2022/017690
PCT Pub. Date: Jan. 27, 2022

(65) Prior Publication Data

US 2023/0271247 A1 Aug. 31, 2023

(30) Foreign Application Priority Data

Jul. 23, 2020 (EP) ..... 20187300

(51) Int. Cl.
*B22D 11/16* (2006.01)
*B21B 1/46* (2006.01)
(Continued)

(52) U.S. Cl.
CPC ..... *B22D 11/1206* (2013.01); *B21B 1/463* (2013.01); *B21B 13/22* (2013.01);
(Continued)

(58) Field of Classification Search
CPC ..... B21B 1/46; B21B 1/463; B21B 13/22; B21B 37/28; B22D 11/12; B22D 11/1206;
(Continued)

(56) References Cited

U.S. PATENT DOCUMENTS 4,711,109 A 12/1987 Rohde et al.
4,793,168 A 12/1988 Kimura
(Continued)

FOREIGN PATENT DOCUMENTS

CN 1500016 A 5/2004
CN 101039762 A 9/2007
(Continued)

OTHER PUBLICATIONS

International Search Report mailed Jul. 13, 2021 in corresponding PCT International Application No. PCT/EP2021/066278.
(Continued)

*Primary Examiner* — Kevin E Yoon
(74) *Attorney, Agent, or Firm* — OSTROLENK FABER LLP

(57) ABSTRACT

A casting-rolling integrated plant that is capable of producing, from a steel melt, in a cost-effective manner and with high productivity, a hot-rolled finished strip having a thickness of ≤0.6 mm, an excellent flatness, and an excellent profile by dividing the thickness reduction into at least three stages (roughing, intermediate and finishing train), measuring the actual profile after the roughing, intermediate and finishing train, and equipping the stands in the roughing, intermediate and finishing train with actuators for influencing the strip profile and/or the strip flatness.

9 Claims, 5 Drawing Sheets

(51) Int. Cl.

| | |
|---|---|
| ***B21B 13/22*** | (2006.01) |
| ***B21B 37/28*** | (2006.01) |
| ***B22D 11/00*** | (2006.01) |
| ***B22D 11/12*** | (2006.01) |
| ***B22D 11/14*** | (2006.01) |
| *B21B 1/08* | (2006.01) |

(52) U.S. Cl.
CPC ..... *B21B 37/28* (2013.01); *B22D 11/002* (2013.01); *B22D 11/142* (2013.01); *B22D 11/16* (2013.01); *B21B 2001/081* (2013.01)

(58) Field of Classification Search
CPC .... B22D 11/1287; B22D 11/142; B22D 11/16
See application file for complete search history.

(56) References Cited

U.S. PATENT DOCUMENTS

| | | | | | |
|---|---|---|---|---|---|
| 5,860,304 | A * | 1/1999 | Anbe | B21B 37/28 72/11.8 |
| 6,314,776 | B1 * | 11/2001 | Puda | B21B 37/28 72/247 |
| 6,983,631 | B2 | 1/2006 | Seidel | |
| 7,963,136 | B2 | 6/2011 | Flick et al. | |
| 10,343,200 | B2 * | 7/2019 | Benedetti | B21B 1/463 |
| 10,625,317 | B2 | 4/2020 | Seidel | |
| 11,674,197 | B2 | 6/2023 | Vignolo et al. | |
| 11,858,022 | B2 | 1/2024 | Fairlie et al. | |

FOREIGN PATENT DOCUMENTS

| | | | | | |
|---|---|---|---|---|---|
| CN | 101868313 | A | | 10/2010 | |
| CN | 102836877 | A | | 12/2012 | |
| CN | 108526221 | A | * | 9/2018 | B21B 1/463 |
| CN | 108698098 | A | | 10/2018 | |
| CN | 110662614 | A | | 1/2020 | |
| EP | 0121148 | A1 | * | 10/1984 | B21B 37/28 |
| EP | 0870553 | A2 | * | 10/1998 | B21B 1/26 |
| EP | 1110635 | A1 | * | 6/2001 | B21B 37/28 |
| EP | 1662012 | B1 | | 5/2010 | |
| EP | 1909979 | B1 | | 10/2010 | |
| EP | 2418031 | A1 | * | 2/2012 | B22D 11/16 |
| EP | 1940566 | B1 | | 3/2012 | |
| EP | 2139622 | B1 | | 10/2012 | |
| EP | 2524971 | A1 | * | 11/2012 | B21B 1/26 |
| EP | 2209573 | B2 | | 1/2018 | |
| JP | 55014133 | A | * | 1/1980 | |
| JP | H06-091313 | A | | 4/1994 | |
| WO | WO 9534388 | A1 | | 12/1995 | |
| WO | WO-2009065840 | A1 | * | 5/2009 | B21B 1/463 |
| WO | WO 2016146621 | A1 | | 9/2016 | |
| WO | WO-2017069378 | A1 | * | 4/2017 | B21B 1/46 |

OTHER PUBLICATIONS

Arvedi et al; "Arvedi ESP first thin slab endless casting and rolling results"; Ironmaking and Steelmaking; Bd. 37, Nr. 4; pp. 271-275; ISSN: 1743-2812; XP002624183; 2010.

* cited by examiner

CASTING-ROLLING INTEGRATED PLANT FOR PRODUCING A HOT-ROLLED FINISHED STRIP FROM A STEEL MELT

CROSS-REFERENCE TO RELATED APPLICATIONS

The present application is a 35 U.S.C. §§ 371 national stage application of International Application No. PCT/EP2021/066278, filed Jun. 16, 2021, which claims priority to European Patent Application No. EP20187300, filed Jul. 23, 2020, the contents of which are incorporated herein by reference.

TECHNICAL FIELD

The present invention relates to the metallurgy of steel materials. Specifically, the invention relates to a casting-rolling integrated plant for producing a hot-rolled finished strip from a steel melt.

PRIOR ART

Casting-rolling integrated plants are known in principle to a person skilled in the art. A steel strip can be produced at low cost and with high productivity from a steel melt on a casting-rolling integrated plant. EP 1 662 012 B1, for example, shows a casting-rolling integrated plant of the Arvedi ESP type. EP 1 909 979 B1 shows a casting-rolling integrated plant for producing plates. EP 1 940 566 B1 and EP 2 139 622 each show a casting-rolling integrated plant of the Arvedi ESP type for producing steel strips with a thickness of 1.5 to 5 mm and 0.8 to 12 mm, respectively.

Although casting-rolling integrated plants have become established, the majority of thin steel strips with a thickness of <0.8 mm are still produced by hot rolling, cold rolling and subsequent annealing. This has the effect that the production of steel strips continues to lead to relatively high $CO_2$ emissions.

THE PUBLICATION

G. Arvedi et al.: 'Arvedi ESP first thin slab endless casting and rolling results', Ironmaking and Steelmaking, Vol. 37, No. 4, pp. 271-275, XP2624183 discloses a casting-rolling integrated plant comprising a continuous casting plant, a three-stand roughing train, an induction furnace, a descaling device, a five-stand finishing train, a cooling section, shears and a coiling device. The Arvedi ESP type casting-rolling integrated plant can produce finished strips with a thickness of 0.8 mm and good geometry.

It is not evident from the prior art how a significant proportion (>10% of the annual production) of steel strips with a thickness ≤0.6 mm, excellent flatness and an excellent profile can be produced on casting-rolling integrated plants without the steel strips having to be cold rolled after hot rolling.

SUMMARY OF THE INVENTION

It is the object of the invention to develop the existing casting-rolling integrated plants to this end and thus to find a novel casting-rolling integrated plant on which it is possible to produce steel strips with a thickness of 0.6 mm, excellent flatness and an excellent profile at low cost and with high productivity without the steel strips having to be cold rolled after hot rolling.

This object is achieved by means of a casting-rolling integrated plant as claimed. Advantageous embodiments form the subject matter of the dependent claims.

Specifically, the solution is achieved by a casting-rolling integrated plant for producing a hot-rolled finished strip, having:

- a continuous casting plant having an arcuate strand guide for the continuous casting of a steel melt to form a continuous strand having a slab or thin slab cross section;
- optionally a slab descaler for descaling the strand before roughing;
- a roughing train having a plurality of, preferably exactly three, roughing stands for roughing the continuous strand to form a roughed strip, wherein at least one, preferably each, roughing stand has at least one actuator for setting the profile and/or the flatness of the roughed strip;
- a first induction furnace for heating the roughed strip to a first rolling temperature;
- a first measuring device for measuring the actual profile of the roughed strip, wherein the first measuring device is arranged between the last roughing stand of the roughing train and the first induction furnace in the material flow direction;
- a first descaling device for descaling the heated roughed strip;
- an intermediate train having a plurality of, preferably exactly three, intermediate rolling stands for intermediate rolling of the continuous roughed strip to form an intermediate strip, wherein at least one, preferably each, intermediate rolling stand has at least one actuator for setting the profile and/or the flatness of the intermediate strip;
- a second measuring device for measuring the actual profile of the intermediate strip;
- optionally a second induction furnace for heating the intermediate strip to a second rolling temperature and a second descaling device for descaling the heated intermediate strip;
- a finishing train having a plurality of, preferably exactly three, finish rolling stands for finish rolling the continuous intermediate strip to form a finished strip, wherein at least one, preferably each, finish rolling stand has at least one actuator for setting the profile and/or the flatness of the finished strip;
- a third measuring device for measuring the actual profile of the finished strip;
- optionally a cooling section for cooling the finished strip to a coiling temperature;
- shears for transversely dividing the finished strip; and
- a coiling device having at least two coiler drums for coiling the finished strip into coils.

The continuous casting plant having an arcuate strand guide is used to cast a continuous strand having a slab or thin slab cross section from a steel melt. The casting speed of the continuous casting plant is, depending on the chemical composition of the steel melt, typically between 4 and 7.5 m/min, the strand thickness between 50 and 130 mm and the strand width between 800 and 2200 mm. The thickness of the partially or completely solidified strand is preferably already reduced in the strand guide, e.g. by means of a liquid or soft-core reduction.

After thorough solidification, the uncut strand is hot rolled in a roughing train having a plurality of, preferably exactly three, roughing stands to form a roughed strip. At least one, preferably each, roughing stand of the roughing train has at least one actuator for setting the profile and/or the flatness of the roughed strip. By means of the actuator or actuators in the roughing stands, the profile of the roughed strip can be set in a specifically intended manner.

A first induction furnace, typically having a plurality of induction modules, heats the continuous roughed strip to a first rolling temperature.

In order to detect the strip profile of the roughed strip, a first measuring device for measuring the actual profile of the roughed strip is arranged between the last roughing stand of the roughing train and the first induction furnace in the material flow direction.

A first descaling device for descaling the heated roughed strip is arranged downstream of the last induction module and upstream of the first intermediate rolling stand of the intermediate train. Here, the upper and lower sides of the roughed strip are descaled, ensuring that no scale can be rolled in during intermediate rolling.

The thickness of the continuous roughed strip is further reduced by hot rolling in the intermediate train with a plurality of, preferably exactly three, intermediate rolling stands to form an intermediate strip. At least one, preferably each, intermediate rolling stand has at least one actuator for setting the profile and/or the flatness of the intermediate strip. By means of the actuator or actuators in the intermediate rolling stands, the profile and the flatness of the intermediate strip can be set in a specifically intended manner.

A second measuring device for measuring the actual profile of the intermediate strip is arranged downstream of the last intermediate rolling stand of the intermediate train.

A second induction furnace, typically having a plurality of induction modules, for heating the intermediate strip to a second rolling temperature is preferably arranged downstream of the intermediate train, and a second descaling device for descaling the intermediate strip is preferably arranged downstream of the second induction furnace and upstream of the first finish rolling stand of the finishing train. Here, the upper and lower sides of the intermediate strip are descaled, ensuring that no scale can be rolled in during finish rolling.

The thickness of the continuous intermediate strip is further reduced by hot rolling in the finishing train with a plurality of, preferably exactly three, finish rolling stands to form a finished strip. At least one, preferably each, finish rolling stand has at least one actuator for setting the profile and/or the flatness of the finished strip. By means of the actuator or actuators in the finish rolling stands, the profile and the flatness of the finished strip can be set in a specifically intended manner.

A third measuring device for measuring the actual profile of the finished strip is arranged downstream of the last finish rolling stand of the finishing train.

A cooling section for cooling the finished strip to a coiling temperature is typically arranged downstream of the finishing train. Here, the upper and lower sides of the finished strip are cooled by a plurality of cooling devices (cooling headers).

The finished strip is divided transversely by shears and coiled into coils in the coiling device by means of at least two coiler drums.

While at least one actuator for setting the profile and/or the flatness of the roughed strip, of the intermediate strip and of the finished strip is mentioned in each case, a person skilled in the art knows that the profile and/or the flatness of strip-shaped rolling stock can be brought about, for example, by bending blocks for bending the working rolls, by actuators for axial displacement of the working rolls (Smart-Crown adjustment), by width-dependent multi-zone cooling of the working or back-up rolls, etc.

By dividing the thickness reduction into at least three stages (roughing, intermediate and finishing train), preferably four stages (e.g. liquid core reduction LCR in the strand guide, roughing, intermediate and finishing train), measuring the actual profile after the roughing, intermediate and finishing train, and equipping the stands in the roughing, intermediate and finishing train with actuators for influencing the strip profile and/or the strip flatness, it is possible to ensure that even an ultra-thin finished strip with a thickness of ≤0.8 mm or even ≤0.6 mm has excellent flatness and an excellent profile. Moreover, the induction furnaces enable the first rolling temperature in the intermediate train, the second rolling temperature in the finishing train and the final rolling temperature in the last stand of the finishing train to be set with high accuracy. The casting-rolling integrated plant according to the invention can thus not only produce a strip with highly accurate geometric properties but also accurately set the temperature curve in the rolling train in accordance with the desired structure of the finished strip.

To enable the profile of the roughed strip to be adjusted, it is advantageous if a first profile controller can control at least one actuator in the roughing train as a function of the actual profile of the roughed strip in such a way that the actual profile of the roughed strip corresponds as far as possible to a setpoint profile.

It is advantageous if the second measuring device is arranged between the last intermediate rolling stand of the intermediate train and the first finish rolling stand of the finish rolling train, preferably between the last intermediate rolling stand of the intermediate train and the second induction furnace, in the material flow direction.

It is particularly advantageous if the second measuring device can also measure the actual flatness of the intermediate strip. This can be accomplished in that the second measuring device comprises a measuring unit for measuring the actual profile and a further measuring unit for measuring the actual flatness.

To enable the profile of the intermediate strip to be adjusted, it is advantageous if a second profile controller can control at least one actuator in the intermediate train as a function of the actual profile of the intermediate strip in such a way that the actual profile of the intermediate strip corresponds as far as possible to a setpoint profile.

To enable the flatness of the intermediate strip to be adjusted, it is advantageous if a first flatness controller can control at least one actuator in the intermediate train as a function of the actual flatness of the intermediate strip in such a way that the actual flatness of the intermediate strip corresponds as far as possible to a setpoint flatness.

The control of the actual profile and the actual flatness in the intermediate train is possible if both control loops are embodied as active and superimposed on one another.

To enable the wear of the working rolls in the finishing train to be compensated, it is advantageous if at least one finish rolling stand of the finishing train, preferably each finish rolling stand of the finishing train, has two displacement devices for the axial displacement of the working rolls in opposite directions. The displacement devices preferably allow what is referred to as "long stroke" displacement of the working rolls with a maximum displacement of 200 mm, 500 mm or 800 mm.

It is advantageous if the third measuring device is arranged between the last finish rolling stand of the finishing train and the coiling device, preferably between the last finish rolling stand of the finishing train and the cooling section, in the material flow direction. The third measuring device too can consist, for example, of two measuring units, a unit for measuring the actual profile and a further unit for measuring the actual flatness.

To enable the profile of the finished strip to be adjusted, it is advantageous if a third profile controller can control at least one actuator in the finishing train as a function of the actual profile of the finished strip in such a way that the actual profile of the roughed strip corresponds as far as possible to a setpoint profile.

To enable the flatness of the finished strip to be adjusted, it is advantageous if a second flatness controller can control at least one actuator in the finishing train as a function of the actual flatness of the finished strip in such a way that the actual flatness of the finished strip corresponds as far as possible to a setpoint flatness.

The control of the actual profile and the actual flatness in the finishing train is possible if both control loops are embodied as active and superimposed on one another.

In a preferred embodiment of the invention with respective measuring devices after the roughing, intermediate and finishing trains, particularly good flatness can be achieved because the relative strip profile after the roughing, intermediate and finishing train can be kept constant and because any profile deviations can be detected and, if appropriate, compensated not only after finish rolling but already after roughing and intermediate rolling. This is advantageous particularly in the case of ultra-thin strips since the relative strip profile can be kept constant during each rolling pass.

In two further preferred embodiments, a) a first temperature profile measuring device for measuring the temperature profile of the roughed strip is arranged between the end of the first induction furnace and the first descaling device, wherein a first temperature controller controls the inductors of the first induction furnace in such a way that the temperature profile corresponds as far as possible to a first setpoint profile, b) a second temperature profile measuring device for measuring the temperature profile of the intermediate strip is arranged between the end of the second induction furnace and the second descaling device, wherein a second temperature controller controls the inductors of the second induction furnace in such a way that the temperature profile corresponds as far as possible to a second setpoint profile.

Both embodiments are based on the insight a. that the temperature profile can be set in an immediate manner by a feedback effect of a temperature profile measuring device on the inductors of the induction furnace, and b. that a homogeneous temperature profile results in homogeneous working roll wear over the width thereof, with homogeneous working roll wear promoting an optimum thickness profile over the width and thus good flatness.

BRIEF DESCRIPTION OF THE DRAWINGS

The above-described properties, features and advantages of this invention and the manner in which these are achieved will become more clearly and distinctly understandable in conjunction with the following description of a number of exemplary embodiments, which are explained in greater detail in conjunction with the drawings. In the drawings.

DESCRIPTION OF THE EMBODIMENTS

Figure 1:
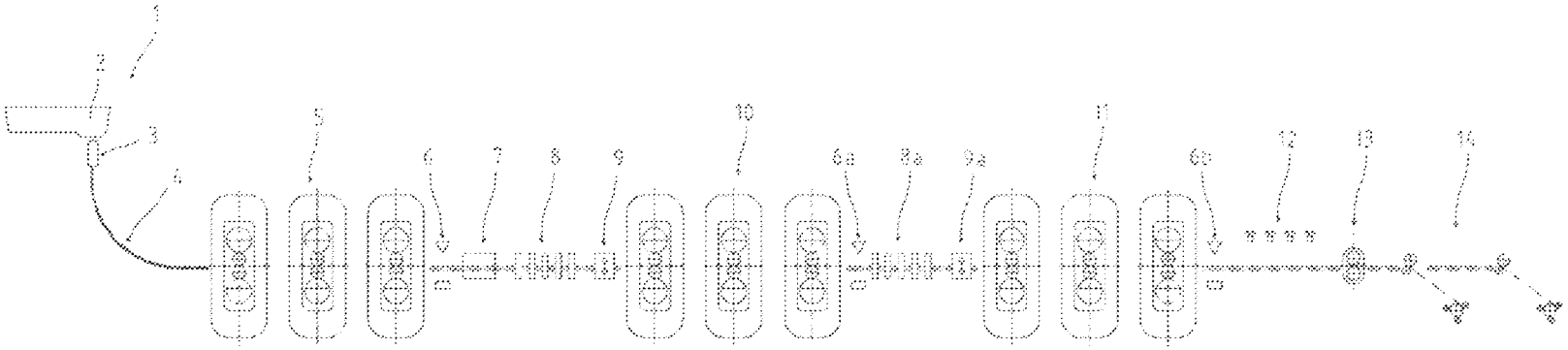
FIG. 1 shows a diagram of a first casting-rolling integrated plant.
Figure 6:
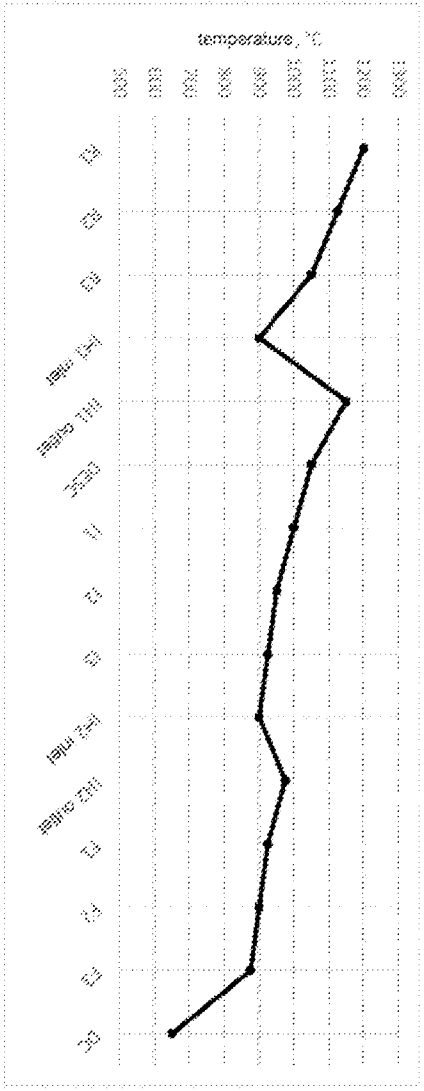
FIG. 6 shows a temperature curve in the production of an ultra-thin finished strip in a casting-rolling integrated plant.
Figure 7:
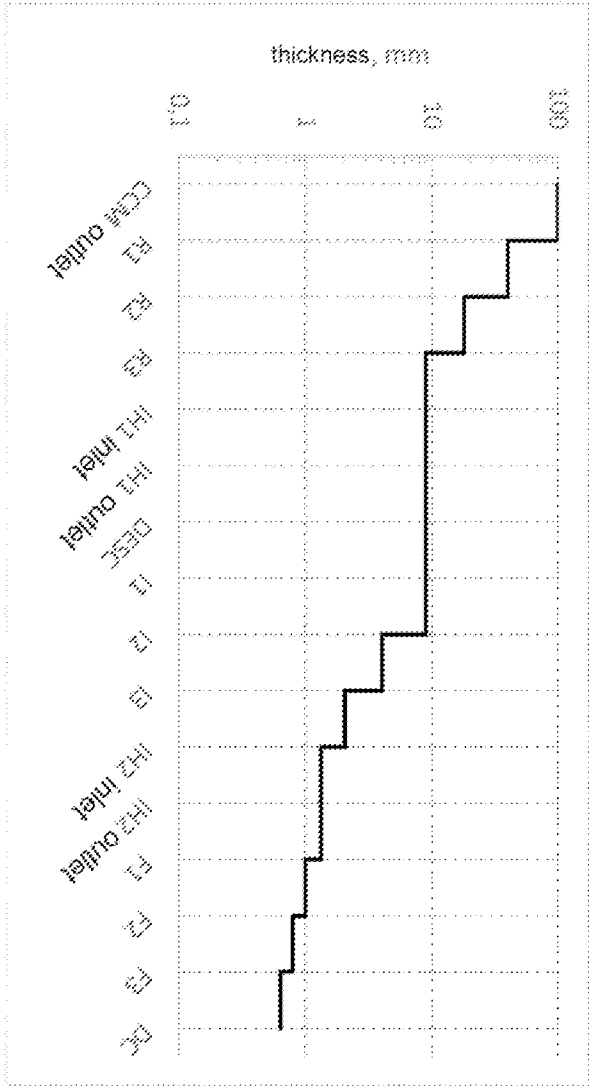
FIG. 7 shows a thickness curve in the production of an ultra-thin finished strip in a casting-rolling integrated plant.

FIG. 1 shows a first embodiment of a casting-rolling integrated plant according to the invention. In the continuous casting plant 1, a steel melt is cast into a continuous strand 4 with a slab format and a final thickness of 100 mm. For this purpose, the steel melt is fed to the mold 3 via a tundish 2. The strand 4 leaves the mold with a thickness of 105 mm. In the arcuate strand guide of the continuous casting plant 1, the thickness of the strand 4 is reduced to the final thickness of 100 mm by an LCR. Subsequently, the strand 4 enters the first roughing stand of the roughing train 5 and is reduced to a roughed strip with a thickness of 9 mm by three rolling passes in the roughing train. The last rolling pass in the roughing train 5 takes place at 900° C. The roughed strip is heated to a temperature of 1150° C. in the first induction furnace 8 and then descaled in the first descaling device 9. During this process, the temperature of the roughed strip falls to 1050° C. In the following intermediate train 10, the roughed strip is reduced to an intermediate strip with a thickness of 1.3 mm by three rolling passes. The last rolling pass in the last intermediate rolling stand of the intermediate train 10 takes place at a temperature of 925° C. The intermediate strip is then heated to a temperature of 975° C. in the second induction furnace 8*a*. Since the heating in the second induction furnace 8*a* takes place very rapidly and by only 50° C., the heated intermediate strip is not descaled in the second descaling device 9*a* and enters directly into the first finish rolling stand of the finishing train 11. In the finishing train 11, the roughed strip is reduced, again by three rolling passes, to an ultra-thin finished strip with a thickness of 0.6 mm. The last rolling pass in the finishing train 11 takes place in the austenitic temperature range at a temperature of 875° C. After the finishing train 11, the finished strip is cooled to 650° C. in the cooling section 12, then divided transversely by the shears 13 and coiled in the coiling devices 14. The method takes place continuously, i.e. the continuous strip is transversely divided for the first time by the shears 13. The temperature curves and the thickness curves during the production of the ultra-thin finished strip with a thickness of 0.6 mm are given in FIGS. 6 and 7.

Figure 2:
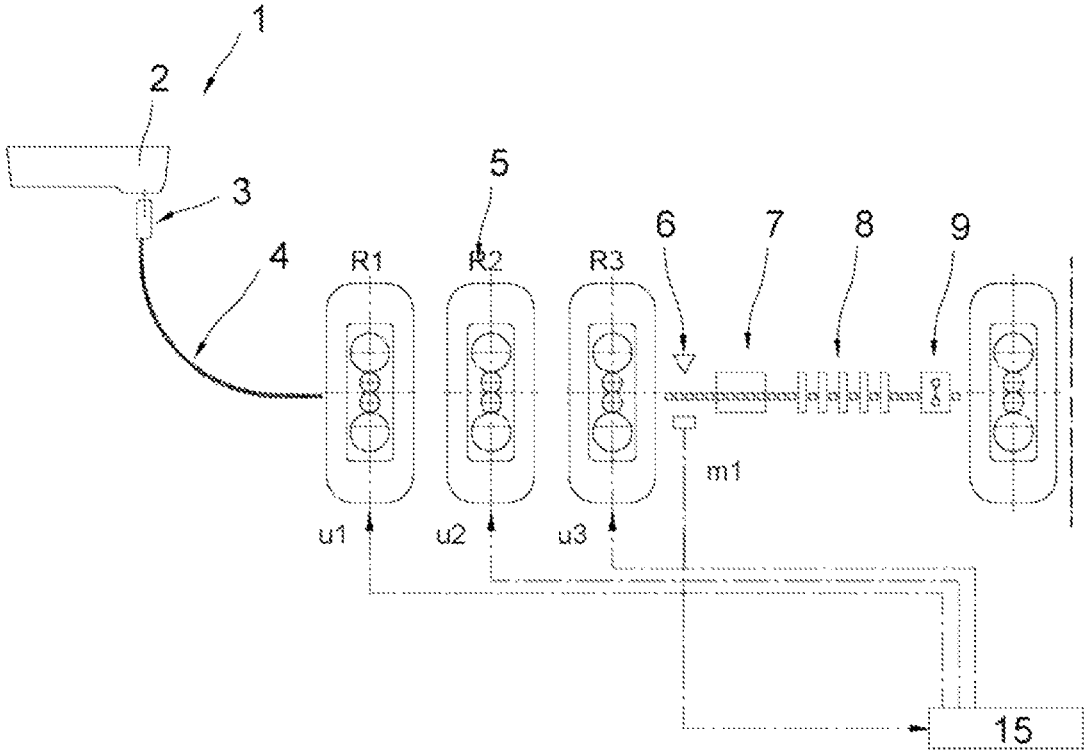
FIG. 2 shows a control diagram for a first profile controller in the roughing train 5 of FIG. 1.

The mode of operation of a first profile controller is explained with reference to FIG. 2. A first measuring device 6 for measuring the actual profile of the roughed strip is arranged downstream of the last roughing stand R3 of the roughing train 5 and upstream of the first induction furnace 8. The measured values m1 for the actual profile of the roughed strip are transmitted to the controller 15. As a function of the measured values m1 for the actual profile and as a function of the setpoint profile of the roughed strip, the controller 15 calculates three manipulated variables u1 . . . u3, which are transmitted to (hydraulic) actuators in the bending blocks for bending the working rolls in the three roughing stands R1 . . . R3 of the roughing train 5. The actuators bend the working rolls of the roughing stands in such a way that the actual profile corresponds as far as possible to the setpoint profile.

Figure 3:
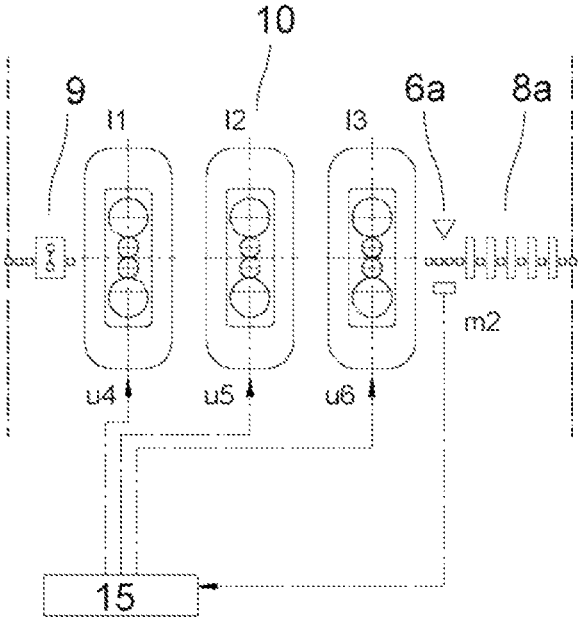
FIG. 3 shows a control diagram for a second profile controller in the intermediate train 10 of FIG. 1.

The mode of operation of a second profile controller is explained with reference to FIG. 3. A second measuring device 6*a* for measuring the actual profile of the intermediate strip is arranged downstream of the last intermediate rolling stand 13 of the intermediate train 10 and upstream of the second induction furnace 8*a*. The measured values m2 for the actual profile are transmitted to the controller 15. As a function of the measured values m2 for the actual profile and as a function of the setpoint profile of the intermediate strip, the controller 15 calculates three manipulated variables u4 . . . u6, which are transmitted to (hydraulic) actuators in the bending blocks for bending the working rolls in the three intermediate rolling stands I1 . . . I3 of the intermediate train 10. The actuators bend the working rolls of the intermediate rolling stands in such a way that the actual profile corresponds as far as possible to the setpoint profile.

Figure 4:
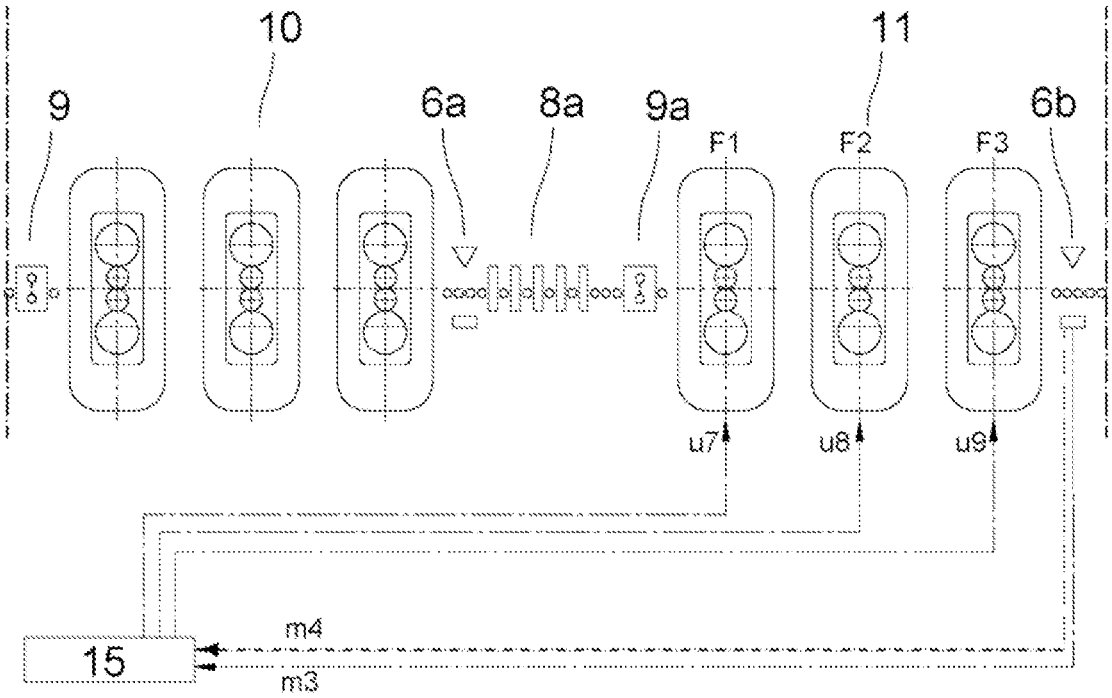
FIG. 4 shows a control diagram for a second flatness controller in the finishing train 11 of FIG. 1.

The mode of operation of a third profile controller and a second flatness controller are explained with reference to FIG. 4. A third measuring device 6*b* for measuring the actual profile m3 and the actual flatness m4 of the finished strip is arranged downstream of the last finish rolling stand F3 of the finishing train 11 and upstream of the cooling section. The mode of operation of the third profile controller is similar to the profile controllers already explained. The second flatness controller functions as follows: the measured values m4 for the actual flatness are likewise transmitted to the controller 15. As a function of the measured values m4 for the actual flatness and as a function of the setpoint flatness of the finished strip, the controller 15 calculates three manipulated variables u7 . . . u9, which are transmitted to (hydraulic) actuators in the bending blocks for bending the working rolls in the three finish rolling stands F1 . . . F3 of the finishing train 11. The actuators bend the working rolls of the finish rolling stands in such a way that the actual flatness corresponds as far as possible to the setpoint flatness.

It is possible for there to be actuators for bending the working rolls, e.g. bending blocks, in the finish rolling stands of the finishing train 11 and additionally for there to be width-dependent multi-zone cooling of the working rolls or possibly even of the back-up rolls.

Figure 5:
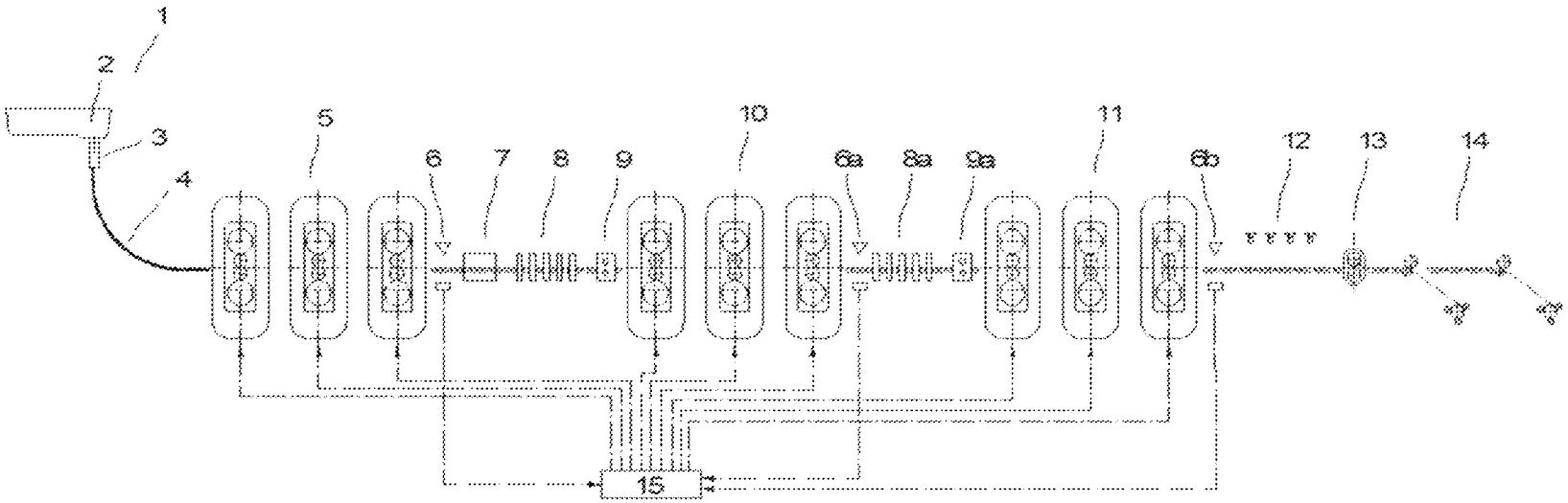
FIG. 5 shows a diagram of a second casting-rolling integrated plant.

FIG. 5 shows the casting-rolling integrated plant of FIG. 1 with three profile controllers for controlling the profile downstream of the roughing, intermediate and finishing trains 5, 10, 11 and two flatness controllers for controlling the flatness downstream of the intermediate and finishing trains 10, 11. The three profile controllers and the two flatness controllers are combined to form a digital controller 15.

Although the invention has been illustrated and described more specifically in detail by means of the preferred exemplary embodiments, the invention is not restricted by the examples disclosed, and other variations can be derived therefrom by a person skilled in the art without exceeding the scope of protection of the invention.

LIST OF REFERENCE SIGNS

1, CCM continuous casting plant
2 tundish
3 mold
4 strand
5 roughing train
6 first measuring device
6*a* second measuring device
6*b* third measuring device
7 roller table
8, IH1 first induction furnace
8*a*, IH2 second induction furnace
9, DESC first descaling device
9*a* second descaling device
10 intermediate train
11 finishing train
12 cooling section
13 shears
14, DC coiling device
15 controller
m1 . . . m4 measured variables
u1 . . . u9 manipulated variables
R1 . . . R3 first to third roughing stand
I1 . . . I3 first to third intermediate rolling stand
F1 . . . F3 first to third finish rolling stand

The invention claimed is:

1. A casting-rolling integrated plant for producing a hot-rolled finished steel strip, comprising:

a continuous casting plant having an arcuate strand guide for the continuous casting of a steel melt to form a continuous strand having a slab or thin slab cross section;

a roughing train having a plurality of roughing stands (R1 . . . R3) for roughing the continuous strand to form a roughed strip, wherein at least one roughing stand has at least one actuator for setting profile and/or flatness of the roughed strip;

a first induction furnace for heating the roughed strip to a first rolling temperature;

a first measuring device for measuring an actual profile of the roughed strip, wherein the first measuring device is arranged between last roughing stand (R3) of the roughing train and the first induction furnace in material flow direction;

a first descaling device for descaling the heated roughed strip;

an intermediate train having a plurality of intermediate rolling stands (I1 . . . I3) for intermediate rolling of the continuous roughed strip to form an intermediate strip, wherein at least one intermediate rolling stand has at least one actuator for setting profile and/or flatness of the intermediate strip;

a second measuring device for measuring an actual profile of the intermediate strip and an actual flatness of the intermediate strip;

a finishing train having a plurality of finish rolling stands (F1 . . . F3) for finish rolling the continuous intermediate strip to form a finished strip, wherein at least one finish rolling stand has at least one actuator for setting profile and/or flatness of the finished strip;

a third measuring device for measuring an actual profile of the finished strip and an actual flatness of the finished strip;

a second induction heater arranged to heat an intermediate strip received from the intermediate train, and feeding the heated intermediate strip to the finishing train directly;

shears for transversely dividing the finished strip;

a coiling device having at least two coiler drums for coiling the finished strip into coils;

a first profile controller that controls the at least one actuator of the at least one roughing stand in the roughing train as a function of the actual profile of the roughed strip in such a way that the actual profile of the roughed strip corresponds as far as possible to a setpoint profile;

a second profile controller that controls the at least one actuator of the intermediate rolling stand in the intermediate train as a function of the actual profile of the intermediate strip in such a way that the actual profile of the intermediate strip corresponds as far as possible to a setpoint profile;

a first flatness controller that controls the at least one actuator of the intermediate rolling stand in the intermediate train as a function of measured actual flatness of the intermediate strip in such a way that actual flatness of the intermediate strip corresponds as far as possible to a setpoint flatness;

a third profile controller that controls the at least one actuator of the at least one finish rolling stand in the finishing train as a function of the actual profile of the finished strip in such a way that the actual profile of the finished strip corresponds as far as possible to a setpoint profile; and a second flatness controller that controls at least one actuator in the finishing train as a function of the measured actual flatness of the finished strip in such a way that actual flatness of the finished strip corresponds as far as possible to a setpoint flatness, wherein the second profile controller and the first flatness controller are active and have outputs thereof superimposed on one another in order to control the actual profile and the actual flatness in the intermediate train, and wherein the third profile controller and the second flatness controller are active and have outputs thereof superimposed on one another in order to control the actual profile and the actual flatness in the finishing train.

2. The casting-rolling integrated plant as claimed in claim 1, wherein the second measuring device is arranged between the last intermediate rolling stand (I3) of the intermediate train and the first finish rolling stand (F1) of the finish rolling train in the material flow direction.

3. The casting-rolling integrated plant as claimed in claim 1, wherein at least one finish rolling stand (F1 . . . F3) of the finishing train has two displacement devices for axial displacement of working rolls of the at least one finish rolling stand in opposite directions.

4. The casting-rolling integrated plant as claimed in claim 3, wherein the displacement devices allow an axial displacement in a range of 200 mm to 800 mm.

5. The casting-rolling integrated plant as claimed in claim 1, wherein the third measuring device is arranged between the last finish rolling stand (F3) of the finishing train and the coiling device in the material flow direction.

6. The casting-rolling integrated plant as claimed in claim 1, wherein a first temperature profile measuring device for measuring a temperature profile of the roughed strip is arranged between the end of the first induction furnace and the first descaling device, wherein a first temperature controller controls inductors of the first induction furnace in such a way that the temperature profile corresponds as far as possible to a first setpoint profile.

7. The casting-rolling integrated plant as claimed in claim 1, wherein a second temperature profile measuring device for measuring a temperature profile of the intermediate strip is arranged between the end of a second induction furnace and a second descaling device, wherein a second temperature controller controls inductors of the second induction furnace in such a way that the temperature profile corresponds as far as possible to a second setpoint profile.

8. The casting-rolling integrated plant as claimed in claim 1, further comprising a slab descaler for descaling the strand before roughing.

9. The casting-rolling integrated plant as claimed in claim 1, further comprising a cooling section for cooling the finished strip to a coiling temperature.

* * * * *